United States Patent [19]

Rooswinkel

[11] Patent Number: 4,776,382

[45] Date of Patent: Oct. 11, 1988

[54] OVERLAPPING STRIP-CURTAIN CONSTRUCTION

[75] Inventor: Johannes Rooswinkel, Roermond, Netherlands

[73] Assignee: Eriks Holding N.V., Netherlands

[21] Appl. No.: 499,278

[22] Filed: May 31, 1983

Related U.S. Application Data

[63] Continuation of Ser. No. 273,586, Jun. 15, 1981, abandoned.

[51] Int. Cl.[4] ..... A47H 1/00

[52] U.S. Cl. ..... 160/332

[58] Field of Search ..... 160/332

[56] References Cited

U.S. PATENT DOCUMENTS 2,410,662 11/1946 Kahn ..... 160/332

4,095,642 6/1977 McKinnon ..... 160/332

*Primary Examiner*—Ramon S. Britts

*Assistant Examiner*—David M. Purol

*Attorney, Agent, or Firm*—Joseph P. Gastel

[57] ABSTRACT

An overlapping strip-curtain construction for mounting on an elongated rod including a plurality of elongated flexible strip members each having an upper end and a lower end, a plurality of loops formed at each upper end of each strip member as integral extensions of the elongated body portion, spaces between the loops, with the body portions of adjacent strip members being in overlapping relationship with each other across their widths and with certain of the loops of each of the strip members being located in certain of the spaces of adjacent strip members.

12 Claims, 1 Drawing Sheet

OVERLAPPING STRIP-CURTAIN CONSTRUCTION

This is a continuation of application Ser. No. 273,586 filed June 15, 1981 now abandoned.

BACKGROUND OF THE INVENTION

The present invention relates to an overlapping strip-curtain construction of the type which is used to close openings, such as doorways, windows or the fronts of cabinets.

SUMMARY OF THE INVENTION

It is an object of the present invention to provide an improved strip-door construction wherein elongated strip members of a standard size may be placed in any degree of desired overlapping relationship with each other when mounted in an opening, such as a doorway, window, the front of an open cabinet, or the like.

Another object of the present invention is to provide an improved overlapping strip-curtain construction in which the upper end portions which mount each of the strips can be fabricated in an extremely simple and expedient manner. Other objects and attendant advantages of the present invention will readily be perceived hereafter.

The present invention relates to an overlapping strip-curtain construction for mounting on an elongated rod comprising a plurality of elongated strip members each having an elongated body portion having a width and an upper end and a lower end, a plurality of hanger members extending across the width of each of said strip members at each of said upper ends of each of said elongated strip members, spaces between said hanger members, said body portions of adjacent strip members being in overlapping relationship with each other across their widths with certain of said hanger members of each of said strip members being located in certain of said spaces of adjacent strip members.

The present invention also relates to a strip construction for an overlapping strip-curtain comprising an elongated strip member having an elongated body portion having a first width and an upper end and a lower end, a plurality of hanger members at said upper end each having a second width which is less than said first width, and spaces between said hanger members which are of a width at least as large as said second width to receive second hanger members of an adjacent strip construction.

The various aspects of the present invention will be more fully understood when the following portions of the specification are read in conjunction with the accompanying drawings wherein:

DETAILED DESCRIPTION OF THE PREFERRED EMBODIMENTS

Figure 1:
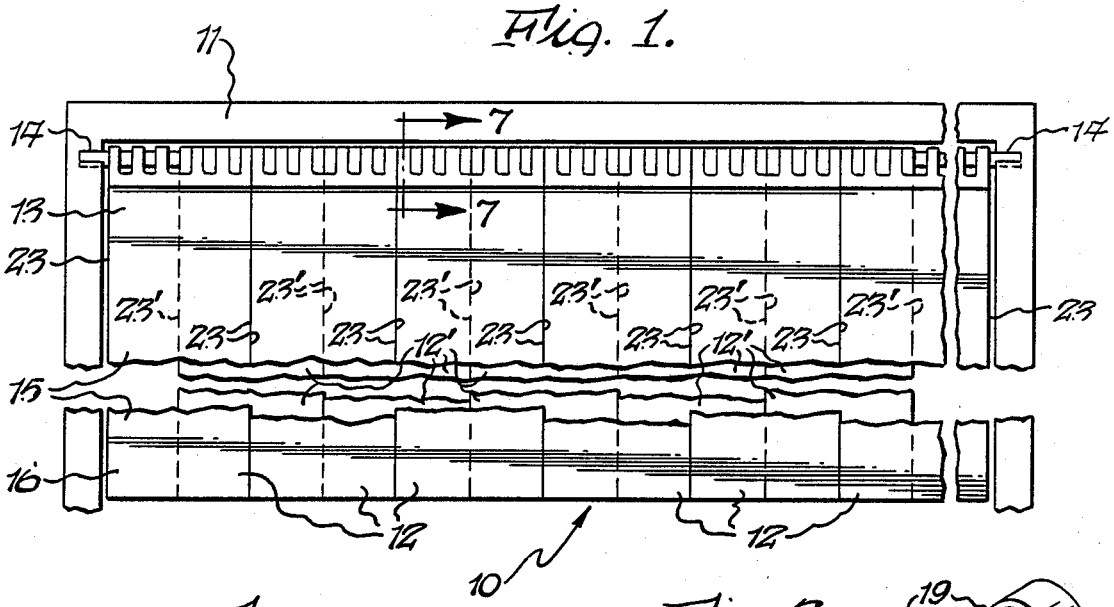
FIG. 1 is a fragmentary side elevational view of an overlapping strip curtain construction of the present invention mounted in an opening such as a doorway or window.

The overlapping strip curtain construction 10 of the present invention is shown in FIG. 1 as being mounted within frame 11 which may comprise a doorway, or a window, or the front of a cabinet, such as a refrigerator showcase. The strip curtain construction 10, when hanging naturally, will close the opening in frame 11. However, in the event that it is desired to pass through the opening in frame 11, it is merely necessary to push through the overlapping strip curtain construction, whereby the elongated strips will separate. After the intrusion through frame 11 has been completed, the strip curtain will fall back into the position shown in FIG. 1 wherein it effectively closes the opening.

The overlapping strip curtain construction of FIG. 1 consists of a plurality of elongated strip members 12 mounted in overlapping relationship and supported at their upper ends 13 on elongated rod 14. Each of strip members 12 includes a body portion 15 having an upper end 13 and a lower end 16. Each strip member 12 is preferably formed of a flexible mnaterial, such as plastic, which may be transparent, leather, or any other suitable material which is relatively thin, but has a width which is relatively large as compared to its thickness.

The upper end 13 of each strip member 12 is formed into a plurality of hanger members 17 with spaces 19 between each of the hanger members 17. Spaces 19 are slightly larger than the width of hanger members 17. As can be seen from FIG. 3, each strip 12 includes two sets of hanger members 17 with spaces 19 therebetween, each set comprising three hanger members 17 and two spaces 19. Centrally located between each set of hanger members and spaces 17–19 is a central space 20 which is at least twice as wide as the width of each hanger member 17.

Figure 2:
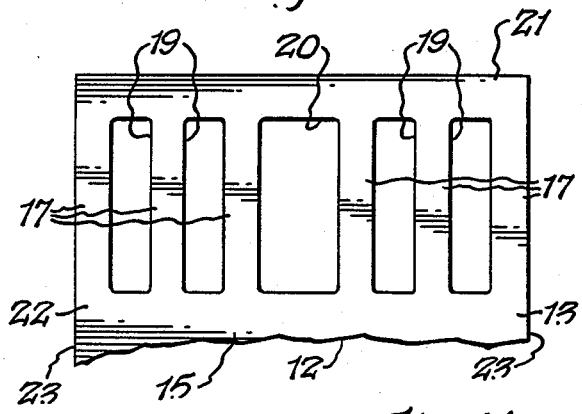
FIG. 2 is a fragmentary side elevational view of a strip member after slots were cut in the upper end thereof and before the upper end was turned back and reattached to the strip to form a plurality of loops with spaces therebetween.
Figure 3:
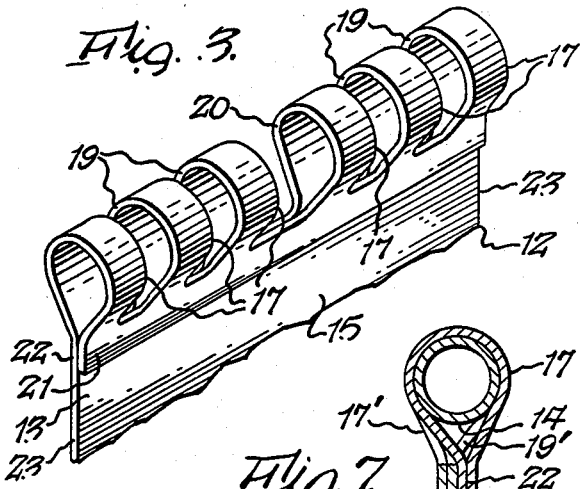
FIG. 3 is a fragmentary perspective view of the upper end of a strip member having spaced loops thereon.

As can be seen from FIG. 3, the hanger members 17 are essentially in the form of loops which have been formed by cutting and bending the upper end 13 of each strip member 12. In this respect, it can be seen from FIG. 2 that the upper end 13 of strip member 12 was cut to provide a plurality of hanger members or loops 17 by cutting out slots 19 and 20. Loops 17 are slightly narrower than slots 19 and the widths of the loops and slots are considerably less than the width of strip member 12. The upper end 13 of each strip member is bent over on itself so that the extreme end portion 21 lies against portion 22 of strip member 12, and in this position portion 21 is secured to portion 22 as by cementing, sonic welding, heat-sealing, or in any other suitable manner. By the foregoing procedure the construction of FIG. 3 is obtained wherein each loop 17 and space 19 are approximately 1/12 the width of strip member 12 and space 20 is approximately 1/6 the width of strip member 12.

By the use of a plurality of strip members 12 each having the above-described configuration at their upper ends, the strip members can be made to overlap different amounts when they are combined to form a strip curtain. In all of the figures, the primed numerals represent the same elements of structure as the unprimed numerals except that the elements designated with primed numerals are associated with strip members which lie behind those represented by unprimed numerals.

Figure 4:
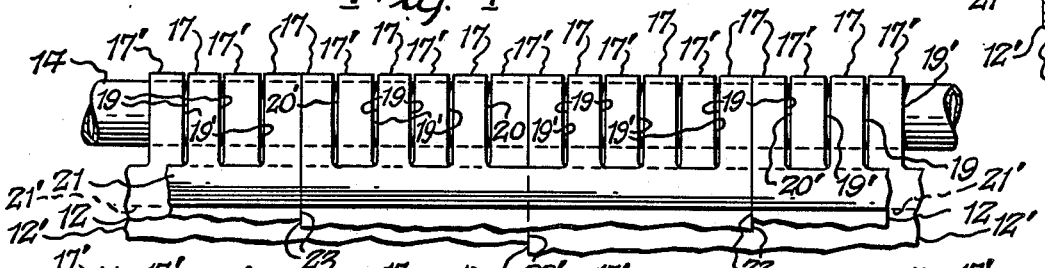
FIG. 4 is a fragmentary side elevational view of certain strip members, such as shown in FIG. 3, being oriented so that they are in 100% overlapping relationship.

In FIG. 4 there is shown an overlapping strip curtain construction in which there is a 100% overlapping relationship between adjacent strips. This relationship is obtained by causing certain of loops 17 of strip members 12 to be received in spaces 19' of strip members 12' and by causing certain loop members 17' of strip members 12' to be received in spaces 19 of strip members 12. Also each of the central spaces 20 and 20' of strip members 12 and 12', respectively, receives the end loops 17' and 17, respectively, of each of strip members 12' and 12, respectively. In view of the foregoing orientation of strip members 12 and 12', all of the strip members 12 lie with their adjacent edges 23 substantially touching, and this is also the case with respect to the adjacent edges 23' of adjacent strip members 12'. By the foregoing orientation, 100% overlapping of the strip members 12 and 12' is obtained. As noted above, it is to be understood that strip members 12 and 12' are identical, except that the unprimed numerals are used to designate the elements of those strip members which lie in front of those strip members which bear the primed numerals.

Figure 7:
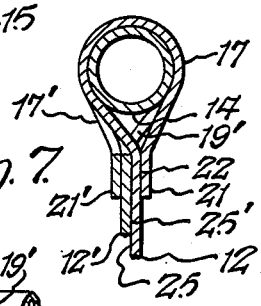
FIG. 7 is a fragmentary cross sectional view taken substantially along line 7—7 of FIG. 1.

As can be seen from FIG. 7, strip members 12 and 12' are so oriented so that the extreme end portions 21 and 21', respectively, lie on opposite sides of the curtain. This permits the faces 25 and 25' of strip members 12 and 12', respectively, to lie flat against each other in the area of end portions 21 and 21' immediately below the loops.

Figure 5:
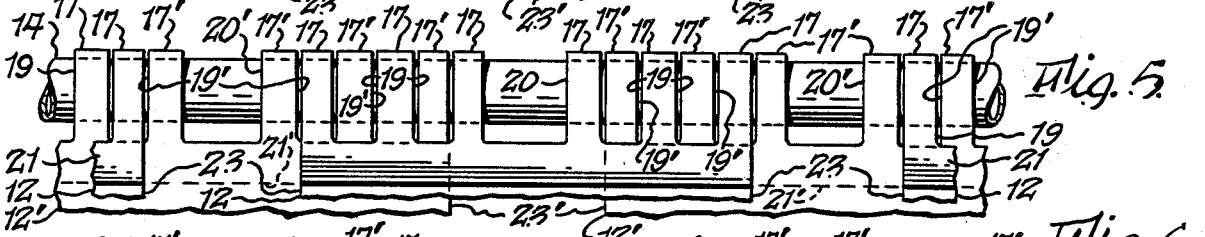
FIG. 5 is a view similar to FIG. 4, but showing certain strip members oriented so that they are in about 66% overlapping relationship.

In FIG. 5 an orientation of strip members 12 and 12' is disclosed in which there is a 66% overlapping relationship. To obtain this, there are no loops placed in either the central spaces 20' or 20 of strip members 12' and 12, respectively. In other words, the orientation is such that the two outer loops at each side of strip members 12 and 12' lie in the two outer spaces at each side of the other strip member adjacent thereto. Thus, there is an overlapping of 8/12 of each of the adjacent strip members 12 and 12' with each other to provide a coverage of 66%. In other words, central spaces 20 and 20' remain empty while the two outer loops 17 at each side of each strip member 12 is received in two outer spaces 19' at each side of each strip member 12' and the two outer loops 17' at each side of each strip member 12' is received in the two outer spaces 19 at each side of each strip member 12.

Figure 6:
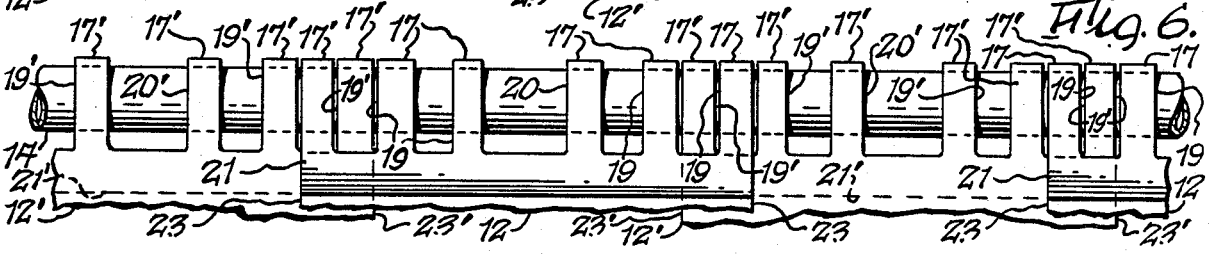
FIG. 6 is a view similar to FIG. 5 but showing certain strip members oriented so that they are in about 33% overlapping relationship.

In FIG. 6 an orientation of strip members 12 and 12' is shown wherein there is approximately 33% overlapping orientation therebetween. In this arrangement, only the outer loop at each side of each strip member is received in the outer space at each side of the other. In other words, loop 17 at each outer end of strip member 12 is received in space 19' of each adjacent strip member 12' and each outer loop 17' of strip member 12' is received in the outermost space 19 of each strip member 12. Thus, the overlap of each strip member 12 and 12' with each other is 4/12 of their width, or approximately 33%.

It can thus be seen that identical strip members 12 and 12' can be oriented relative to each other in different degrees of overlapping relationship, depending on the number of loops of each strip member which is inserted into the spaces of an adjacent strip member. It will be appreciated that since the loops, such as 19, and spaces, such as 17, are of substantially equal width, the strip members 12 and 12' will not shift laterally relative to each other when they are assembled. In the foregoing respect, it is to be understood that even though the preceding description has indicated that the loops are only slightly smaller than certain of the spaces, the loops and spaces are considered to be of substantially equal width. The drawings are not to scale.

It will also be appreciated that by varying the dimensions of the loops and spaces from those given above, different degrees of overlapping may be obtained.

While preferred embodiments of the present invention have been disclosed, it will be appreciated that it is not limited thereto but may be otherwise embodied within the scope of the following claims.

What is claimed is:

1. An overlapping strip-curtain construction for mounting on an elongated rod comprising a plurality of elongated flexible strip members each having an elongated body portion having a width and an upper end and a lower end, a plurality of hanger members in the form of loops extending across the width of each of said strip members at each of said upper ends of each of said elongated strip members, spaces between said loops, said body portions of adjacent strip members being in overlapping relationship with each other across their widths with certain of said loops of each of said strip members being located in certain of said spaces of adjacent strip members, said certain of said loops and said certain of said spaces being of substantially the same width, whereby the locating of certain of said loops in certain of said spaces prevents said upper ends of adjacent strip members from shifting widthwise relative to each other.

2. An overlapping strip-curtain construction for mounting on an elongated rod as set forth in claim 1 wherein each of said upper ends includes at least three loops with at least two spaces therebetween.

3. An overlapping strip-curtain construction for mounting on an elongated rod as set forth in claim 2 including a central space in each strip member which is at least twice the width of each of said loops.

4. An overlapping strip-curtain construction for mounting on an elongated rod as set forth in claim 1 wherein each of said upper ends includes an even number of loops and an odd number of spaces therebetween.

5. An overlapping strip-curtain construction for mounting on an elongated rod as set forth in claim 4 wherein all spaces in excess of one are of substantially the same width as said loops and a central space between said loops which is at least twice as wide as said loops.

6. An overlapping strip-curtain construction for mounting on an elongated rod as set forth in claim 1 wherein said loops and spaces are formed by cutting slots at the end of each strip member and bending the end of each strip member and fastening the extreme outer end to said body portion to provide fastened ends, and wherein said fastened ends of overlapping strip members lie on opposite sides of the outsides of said strip curtain, and wherein said overlapping strip members lie flat against each other in face-to-face relationship immediately below said loops.

7. An overlapping strip-curtain construction for mounting on an elongated rod as set forth in claim 1 wherein said strip members have sufficient loops and spaces at opposite sides of each of said upper ends so that various amounts of overlapping of adjacent strip members can be obtained by placing different numbers of loops of strip members in different numbers of spaces of substantially equal width of adjacent strip members to thereby effect overlapping of adjacent strip members varying amounts while retaining the capacity to prevent said widthwise shifting of overlapping strip members relative to each other.

8. An overlapping stirp-curtain construction as set forth in claim 7 wherein said elongated strip members are of substantially uniform width throughout their lengths.

9. An overlapping strip-curtain construction as set forth in claim 7 wherein each of said elongated strip members has at least three loops and two spaces therebetween at each opposite side of each of said upper ends.

10. An overlapping strip-curtain construction for mounting on an elongated rod comprising a plurality of elongated strip members each having an elongated body portion having a width and an upper end and a lower end, a plurality of hanger members extending across the width of each of said strip members at each of said upper ends of each of said elongated strip members, spaces between said hanger members, said body portions of adjacent strip members being in overlapping relationship with each other across their widths with certain of said hanger members of each of said strip members being located in certain of said spaces of adjacent strip members, said hanger members being loops, each of said upper ends including six loops with five spaces therebetween, with each two of said loops on each outer side of said strip member being of substantially equal width, two outer spaces on each side of each of said strip members between said loops, and a central space between said six loops, said central space being at least twice the width of each of said loops.

11. An overlapping strip-curtain construction for mounting on an elongated rod as set forth in claim 10 wherein said loops and spaces are formed by cutting slots at the end of each strip member and bending the end of each strip member and fastening the extreme outer end to said body portion to provide fastened ends, and wherein said fastened ends of overlapping strip members lie on the outsides of said strip curtain.

12. An overlapping strip-curtain construction for mounting on an elongated rod comprising a plurality of elongated flexible strip members each having an elongated body portion having a length and a width and a thickness and an upper end and a lower end with said length being greater than said width and said width being greater than said thickness, a plurality of hanger members in the form of loops each having first widths extending widthwise across the width of each of said strip members at each of said upper ends of each of said elongated strip members with at least one loop being located substantially at each outer edge of each of said strips, spaces having second widths between said loops, said first widths of said loops and said second widths of said spaces being substantially equal, said loops comprising more than two loops and said plurality of spaces comprising at least two spaces, said body portions of adjacent strip members being in overlapping relationship with each other across certain portions of their widths with certain of said loops of each of said strip members being located in certain of said spaces of adjacent strip members with at least said one loop at each of said outer edges fitting snugly in a space of an adjacent strip member to prevent said upper ends of adjacent strip members from shifting widthwise relative to each other when mounted on said rod without the use of independent fastening means for fastening said strip members to said rod.

* * * * *